US012600529B2

(12) United States Patent
Wadekar et al.

(10) Patent No.: US 12,600,529 B2
(45) Date of Patent: Apr. 14, 2026

(54) PILFERPROOF CAP ASSEMBLY FOR A CONTAINER

(71) Applicant: RELIANCE BP MOBILITY LIMITED, Mumbai City (IN)

(72) Inventors: Rudraksha Ramrao Wadekar, Mumbai (IN); Anant Tandon, Lucknow (IN); Atanu Pramanik, Vasco de Gama (IN); Tarkesh Rajesh Badhwar, Mumbai (IN); Krishna Pendyala, Thane (IN)

(73) Assignee: RELIANCE BP MOBILITY LIMITED, Mumbai City (IN)

( * ) Notice: Subject to any disclaimer, the term of this patent is extended or adjusted under 35 U.S.C. 154(b) by 487 days.

(21) Appl. No.: 18/332,227

(22) Filed: Jun. 9, 2023

(65) Prior Publication Data

US 2023/0399148 A1 Dec. 14, 2023

(30) Foreign Application Priority Data

Jun. 10, 2022 (IN) ..... 202221033338
Jun. 10, 2022 (IN) ..... 202221033384

(51) Int. Cl.

| | |
|---|---|
| ***B65D 41/04*** | (2006.01) |
| ***B65D 47/08*** | (2006.01) |
| ***B65D 47/12*** | (2006.01) |
| ***B65D 47/24*** | (2006.01) |
| ***B65D 47/32*** | (2006.01) |
| ***B65D 49/08*** | (2006.01) |

(52) U.S. Cl.
CPC ..... *B65D 41/0485* (2013.01); *B65D 41/0492* (2013.01); *B65D 47/0866* (2013.01); *B65D 47/123* (2013.01); *B65D 47/244* (2013.01); *B65D 47/32* (2013.01); *B65D 49/08* (2013.01)

(58) Field of Classification Search
CPC ..... B65D 49/08; B65D 41/0485; B65D 41/0492; B65D 2211/00; B65D 2401/00
See application file for complete search history.

(56) References Cited

U.S. PATENT DOCUMENTS 3,902,621 A * 9/1975 Hidding ..... B65D 41/3409 215/254
4,310,102 A * 1/1982 Walter ..... B65D 23/003 222/153.07

(Continued)

*Primary Examiner* — Randall A Gruby
(74) *Attorney, Agent, or Firm* — Osha Bergman Watanabe & Burton LLP

(57) ABSTRACT

The present disclosure relates to a pilferproof cap assembly (100) for a container(10). The assembly(100) is configured to facilitate refilling and decanting of fluid in the container (10). The assembly(100) comprises a neck housing(12) and an adaptor(40). The neck housing(14) is configured to be fitted on an opening of the container(10). The neck housing (12) is provided with a linearly displaceable diaphragm(24) to define a fluid-orifice(50) for fluid flow, and an air-orifice (30) to facilitate air flow. The adaptor(40) is configured to be mounted on an operative top of the neck housing(12) and is further configured to actuate the fluid-orifice(50) and the air-orifice(30) in an operative configuration of the assembly (100). The assembly thus facilitates the refilling and decanting of fluid therefrom in a pilferproof manner.

16 Claims, 19 Drawing Sheets

(56) References Cited

U.S. PATENT DOCUMENTS

| | | | | | |
|---|---|---|---|---|---|
| 5,104,008 | A * | 4/1992 | Crisci | B65D 47/243 | 222/153.07 |
| 5,511,692 | A * | 4/1996 | Willingham | B67D 7/0294 | 141/351 |
| 7,134,567 | B2 * | 11/2006 | Luburic | B65D 43/0256 | 220/276 |
| 7,575,121 | B2 * | 8/2009 | Ooka | B65D 41/3428 | 215/344 |
| 9,902,530 | B2 * | 2/2018 | Smith | B65D 41/34 | |
| 9,932,158 | B2 * | 4/2018 | Rognard | B65D 47/0838 | |
| 10,377,534 | B2 * | 8/2019 | Hanan | B65D 41/3409 | |
| 10,532,858 | B2 * | 1/2020 | Druitt | B65D 41/34 | |
| 11,046,490 | B2 * | 6/2021 | Cerveny | B65D 55/12 | |
| 2020/0304324 | A1 * | 9/2020 | Castle | E05B 19/0052 | |
| 2025/0340343 | A1 * | 11/2025 | Finkelstein | B65D 50/046 | |

* cited by examiner

PILFERPROOF CAP ASSEMBLY FOR A CONTAINER

This application is a cognate of application no. 202221033384 filed on 10 Jun. 2022 and application no. 202221033338 filed on 10 Jun. 2022.

FIELD OF INVENTION

The present disclosure relates to a field of pilferproof cap assembly and security of container. More specifically, it relates to a combination of a container and a closure which ensures pilferproof and tamperproof.

BACKGROUND

The background information herein below relates to the present disclosure but is not necessarily prior art.

Typically, cans or containers are widely used for storing and transporting liquids such as fuel, chemicals, agrochemicals, medicaments, beverages, etc.,. Once containers reach the markets or to the customer site, they are decanted to access the stored fuel, agrochemicals, medicaments, and beverage. The container has an opening on which an adaptor is fitted. The adaptor enables refilling and decanting of the liquid from the container.

The conventional adaptor acts as both inlet and outlet to allow the liquid to flow into and out of the container. A cap is secured to the adaptor for preventing access to the container. The only known technique for preventing pilfering of the liquid is by providing caps having sealing means. However, the sealing means is not a foolproof technique as it can be broken and re-fixed to fool a user. Once the cap is broken, the liquid contained in the container can be easily decanted and replaced by another liquid of inferior quality.

Further, different containers are used to store, transport, and dispense fluids like fuel, oil, petrol, diesel, or any other type of liquid. The conventional containers include a fuel tank with an opening for pouring fuel into another container. Such containers are useful for fluid delivery in non-transport sectors including DG sets, construction machinery, agricultural equipment, etc.

Typically, when orders for fuel are received from the customers remotely, a channel partner assigns orders to a delivery/driver partner and routes the order details to a retail outlet. The retail outlet prepares and fills portable fluid containers according to the received order details. The containers are then transported to the customer's premises by the driver partner.

Currently, there does not exist any system for ensuring the secure delivery of portable fluid containers to their destination as per the customer's orders. In addition, conventional containers are prone to theft and pilferage during storage and transportation of liquids stored in liquid containers, and conventional systems cannot detect such theft or pilferage.

Therefore, there is a need to provide a pilferproof cap assembly for a container for refilling and decanting of fluid that alleviates the aforementioned drawbacks.

OBJECTS

Some of the objects of the present disclosure, which at least one embodiment herein satisfies, are as follows:

An object of the present disclosure is to a pilferproof cap assembly for a container.

Another object of the present disclosure is to a pilferproof cap assembly for a container which facilitates refilling and decanting of fluid therefrom in a pilferproof manner.

Still another object of the present disclosure is to a pilferproof cap assembly for a container that prevents pilfering of liquid therefrom.

Yet another object of the present disclosure is to a pilferproof cap assembly for a container that prevents adulteration of liquid stored therein.

Still another object of the present disclosure is to a pilferproof cap assembly for a container that identifies and monitors the pilfer-proof fluid containers (PFCs).

Yet another object of the present disclosure is to a pilferproof cap assembly for a container that that ensures secure delivery of PFCs from retail outlets to destinations.

Still another object of the present disclosure is to a pilferproof cap assembly for a container that ensures delivery of PFCs to the customers based on their orders.

Yet another object of the present disclosure is to a pilferproof cap assembly for a container that that monitors the quantity of PFCs in a trip.

Still another object of the present disclosure is to a pilferproof cap assembly for a container that detects pilferage or theft of fluid from the PFCs.

Yet another object of the present disclosure is to a pilferproof cap assembly with a system for identification and monitoring of pilfer-proof fluid containers (PFCs) and a method thereof.

Still another object of the present disclosure is to a pilferproof cap assembly with a system for identification and monitoring of pilfer-poof fluid containers that ensures secure delivery of PFCs from retail outlets to destinations.

Yet another object of the present disclosure is to provide a system for identification and monitoring of pilfer-proof fluid containers that ensures delivery of PFCs to the customers based on their orders.

Still another object of the present disclosure is to a pilferproof cap assembly with a system for identification and monitoring of pilfer-proof fluid containers that monitors the quantity of PFCs in a trip.

Yet another object of the present invention is to a pilferproof cap assembly with a system for identification and monitoring of portable fluid containers that detects pilferage or theft of fluid from the PFCs.

Other objects and advantages of the present disclosure will be more apparent from the following description when read in conjunction with the accompanying figures, which are not intended to limit the scope of the present disclosure.

SUMMARY

The present disclosure envisages a pilferproof cap assembly for a container. The assembly is configured to facilitate refilling and decanting of fluid in the container. The assembly comprises a neck housing and an adaptor. The neck housing is configured to be fitted on an opening of the container. The neck housing is provided with a linearly displaceable diaphragm to define a fluid-orifice for fluid flow, and an air-orifice to facilitate air flow. The adaptor is configured to be mounted on an operative top of the neck housing and is further configured to actuate the operative portion of the neck housing to operate the fluid-orifice and the air-orifice in an operative configuration of the assembly.

Further, the neck housing includes an enclosure, a hollow shaft, the diaphragm, a non-return valve (NR-valve), and a fulcrum. The enclosure is defining an outer body of the neck housing and is configured with a plurality of perforations and first central passage to facilitate fluid flow and air flow separately. The hollow shaft is configured to be lockingly received within the first central passage against the compressive force of a biasing means and is further configured to protrude out from the first central passage. The diaphragm is configured to be concentrically fitted within the enclosure such that second central passage defined on the diaphragm is configured to be locked to an operative portion of the hollow shaft. The non-return valve (NR-valve) is configured with the air-orifice and a guide-channel slopping downward from the air-orifice. The air-orifice is configured to be in fluid communication with the second central passage. The fulcrum is pivotally mounted to the NR-valve, and is configured to lift a closing means along the guide channel to enable opening and closing of the air-orifice.

In an embodiment, the adaptor is configured with a plurality of perforations. The fluid orifice of the neck housing and the plurality of perforations are in fluid communication in an operative configuration of the assembly.

In an embodiment, a flap-plate is configured to extend from a circumferential edge of the diaphragm. The flap-plate is configured with a guide-way to guide the closing means within the guide channel.

In an embodiment, the fulcrum is configured with a pair of arms. Each of the arm is configured to extend from the fulcrum point on either side of the non-return valve.

In an embodiment, a pair of flange portion is configured with a D-shaped contours are provided along the enclosure. Each of the arm is configured to abut on an operative surface of each of the D-shaped contour.

Further, the adaptor includes first passage, second passage and a central piston. The first passage is configured to facilitate air to flow through the adaptor during refilling and decanting, whereas, the second passage is configured to facilitate flow of fluid through the adaptor during filling and decanting. The central piston is defined by a hollow-tubular body, and is configured to abut an operative portion of the first passage and connect the first passage with an operative portion of the hollow shaft.

In an embodiment, the adaptor further includes a lever. The lever is configured to move from idle position to an upright position to linearly displace the hollow shaft against the biasing force of the biasing means to facilitate the opening of the fluid-orifice defined between the enclosure and the diaphragm and opening of the air-orifice of the non-return valve.

BRIEF DESCRIPTION OF THE ACCOMPANYING DRAWING

A pilferproof cap assembly for a container of the present disclosure will now be described with the help of the accompanying drawing, in which.

LIST OF REFERENCE NUMERALS

Figure 1:
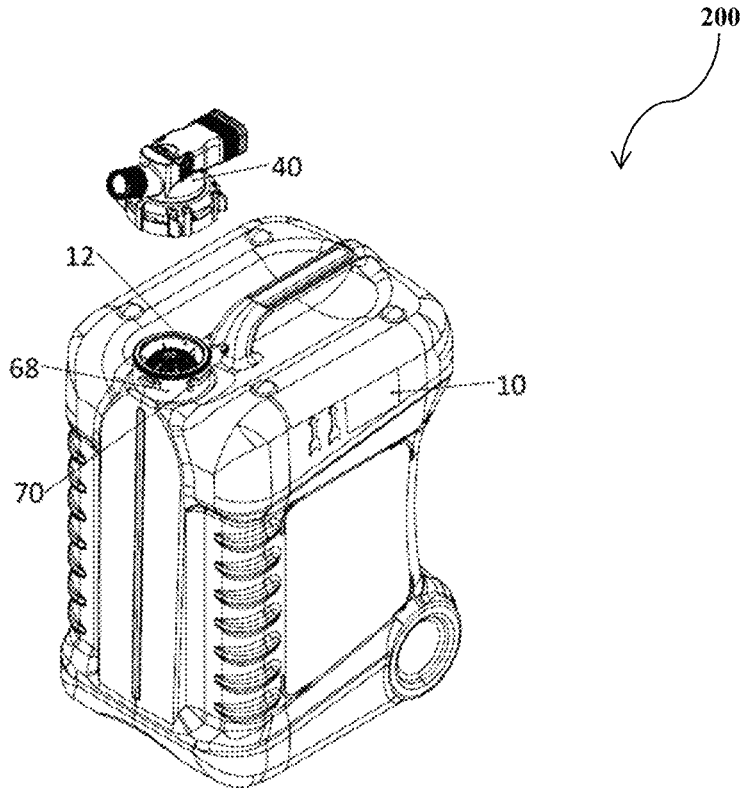
FIG. 1 illustrates an isometric view of an adaptor and a container fitted with a neck housing, in accordance with an embodiment of the present disclosure.

200 An assembly for refilling and decanting liquid from containers
100 pilferproof cap assembly
10 container
12 neck housing
14 enclosure
16 plurality of perforations
18 first central passage
20 hollow shaft

20*a* circular groove of shaft
20*b* threaded portion on shaft
22 biasing means
24 diaphragm
26 second central passage
28 non-return valve (NR-valve)
28*a* third central passage
30 air-orifice
32 guide-channel
32*a* flat base portion of guide-channel
34 fulcrum
36 fulcrum point
38 closing means
38*a* closing means depression
40 adaptor
40*a* housing of the adaptor
40*b* fluid flow region
40*c* peripheral engagement region
42 first passage
44 second passage
46 central piston
46*a* opening of central piston
48 lever
48*a* actuator link
50 fluid-orifice
52 flap-plate
54 guide-way of flap-plate
56 pair of aims
58 flange portion
60 pair of lugs
62 pin
64 locking fixtures
66 end cap
68 neck region
70 protrusion
72*a* air flow path during filling
72*b* air flow path during decanting
74*a* fluid flow path during filling
74*b* fluid flow path during decanting
76 tamper evident sealing means
10*a-n* Pilfer-proof fluid containers
102 Identification media
104 First application module
106 Second application module
114 Third application module
108 Server
108*a* Repository
108*b* Computation module
110 Radio Frequency Identification (RFID) Tag
112 Controller unit

DETAILED DESCRIPTION

Embodiments, of the present disclosure, will now be described with reference to the accompanying drawing.

Embodiments are provided so as to thoroughly and fully convey the scope of the present disclosure to the person skilled in the art. Numerous details are set forth, relating to specific components, and methods, to provide a complete understanding of embodiments of the present disclosure. It will be apparent to the person skilled in the art that the details provided in the embodiments should not be construed to limit the scope of the present disclosure. In some embodiments, well-known processes, well-known apparatus structures, and well-known techniques are not described in detail.

The terminology used, in the present disclosure, is only for the purpose of explaining a particular embodiment and such terminology shall not be considered to limit the scope of the present disclosure. As used in the present disclosure, the forms "a," "an," and "the" may be intended to include the plural forms as well, unless the context clearly suggests otherwise. The terms "comprises," "comprising," "including," and "having," are open ended transitional phrases and therefore specify the presence of stated features, elements, and/or components, but do not forbid the presence or addition of one or more other features, elements, components, and/or groups thereof.

When an element is referred to as being "mounted on," "engaged to," "connected to," or "coupled to" another element, it may be directly on, engaged, connected or coupled to the other element. As used herein, the term "and/or" includes any and all combinations of one or more of the associated listed elements.

Terms such as "inner," "outer," "beneath," "below," "lower," "above," "upper," and the like, may be used in the present disclosure to describe relationships between different elements as depicted from the figures.

Typically, a conventional adaptor acts as both inlet and outlet to allow the liquid to flow into and out of the container. A cap is secured to the adaptor for preventing access to the container. The only known technique for preventing pilfering of the liquid is by providing caps having sealing means. However, the sealing means is not a foolproof technique as it can be broken and re-fixed to fool a user. Once the cap is broken, the liquid contained in the container can be easily decanted and replaced by another liquid of inferior quality.

Further, when orders for fuel are received from the customers remotely, a channel partner assigns orders to a delivery/driver partner and routes the order details to a retail outlet. The retail outlet prepares and fills portable fluid containers according to the received order details. The containers are then transported to the customer's premises by the driver partner. Conventionally, there does not exist any system for ensuring the secure delivery of portable fluid containers to their destination as per the customer's orders. In addition, conventional containers are prone to theft and pilferage during storage and transportation of liquids stored in liquid containers, and conventional systems cannot detect such theft or pilferage.

In order to address the aforementioned problems, the present disclosure envisages a pilferproof cap assembly for a container. The assembly configured to facilitate refilling and decanting of fluid in the container. The pilferproof cap assembly (herein after referred to as "assembly 100") and an assembly for refilling and decanting fluid therefrom in pilferproof manner will now be described with reference to FIG. 1 through FIG. 20. The preferred embodiment does not limit the scope and ambit of the present disclosure.

Figure 2:
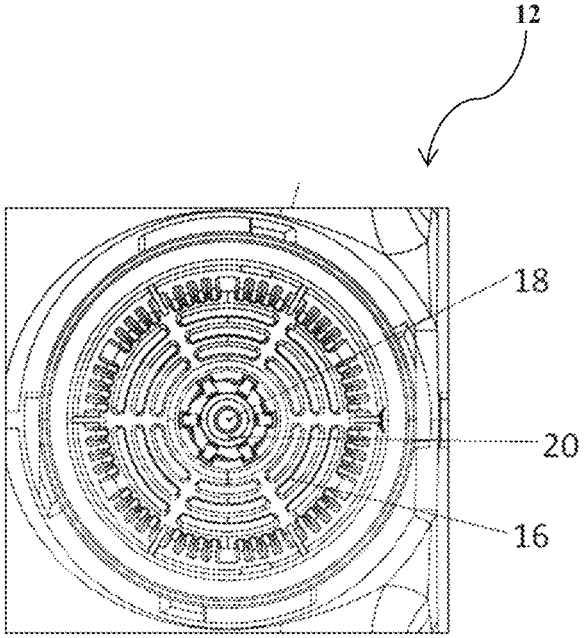
FIG. 2 illustrates a top view of the neck housing of the container of FIG. 1.
Figure 3:
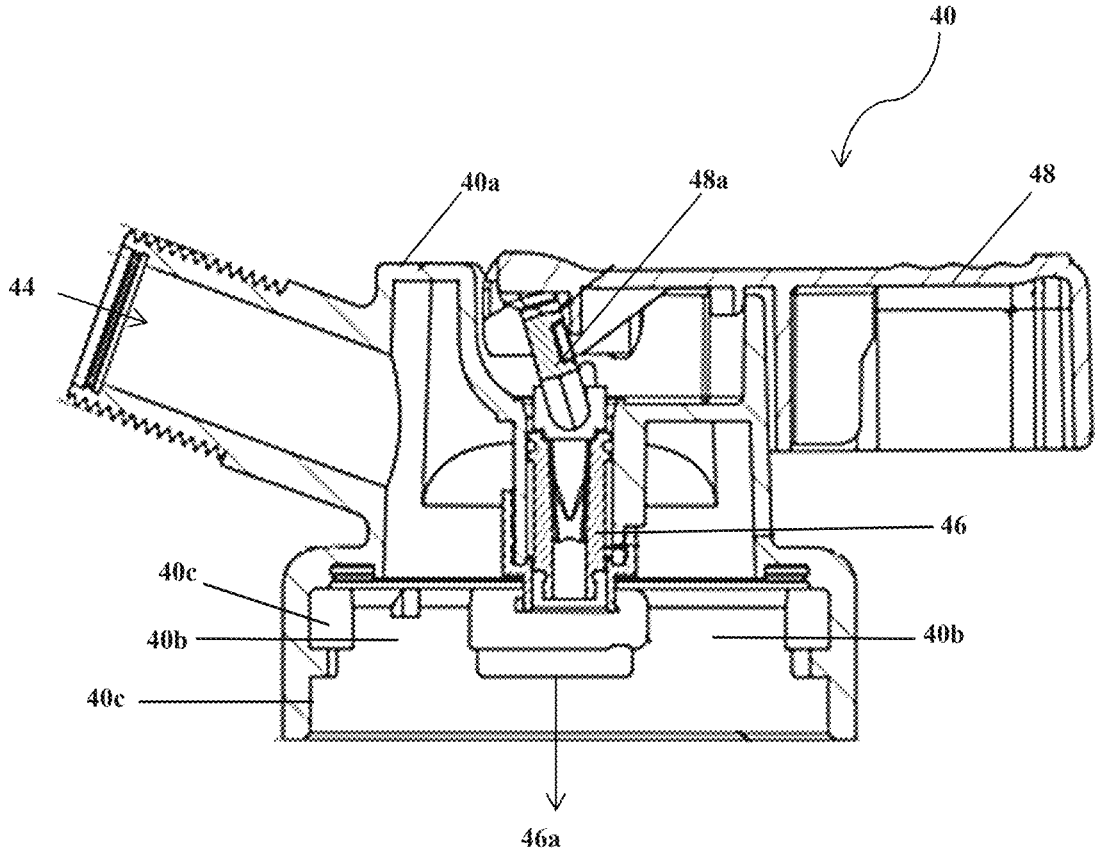
FIG. 3 illustrates a sectional view the adaptor of FIG. 1 in shut-off or idle position of the lever.

As shown in FIG. 1, FIG. 2, and FIG. 3, the assembly (100) comprises a neck housing (12) configured to be fitted on an opening of the container (10), and an adaptor (40), configured to be mounted on an operative top of the neck housing (12). The neck housing comprises a enclosure (14), a hollow shaft (20), a diaphragm (24), a non-return valve (NR-valve) (28), and a fulcrum (34. The enclosure defines an outer body of the neck housing (12) which is configured with a plurality of perforations (16) to facilitate fluid flow across it. Also, the enclosure is provided with a pair of D-shaped contours (58) and a first central passage (18). The first central passage (18) is configured to facilitate air flow separately. The plurality of perforations (16) are provided around the first central passage (18). The first central passage (18) is provided with a biasing means (22) through which the hollow shaft (20) is configured to pass through and an operative tail end of the hollow shaft (20) protrude out though the first central passage (18). The hollow shaft (20) is configured with a circular groove (20*a*) and a threaded portion (20*b*) thereon.

In an embodiment, an upper portion of the hollow shaft (20) is configured with the groove (20*a*) and a lower portion of the hollow shaft (20) is configured with the threaded portion (20*b*).

In a preferred embodiment, the diameter of the hollow shaft (20) is slightly lesser than the inner diameter of the first central passage (18), to thereby enable to free movement of the hollow shaft (20) within the inner periphery of the first central passage (18).

Figure 4A:
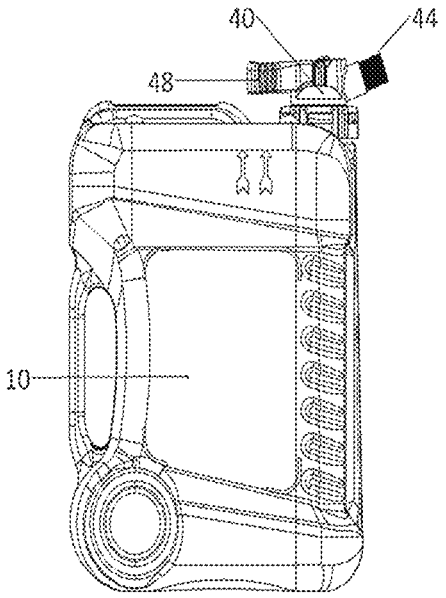
FIG. 4A illustrates an isometric view of the assembly of adaptor and the neck housing on the container for refilling and decanting of fluid of FIG. 1 in shut-off position in accordance with an embodiment of the present disclosure.
Figure 4B:
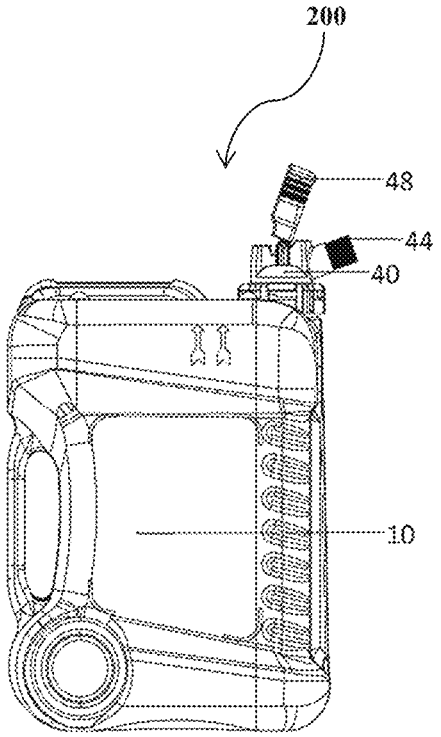
FIG. 4B illustrates an isometric view of the assembly of adaptor and the neck housing on the container for refilling and decanting of fluid of FIG. 1 in ON position in accordance with an embodiment of the present disclosure.
Figure 5:
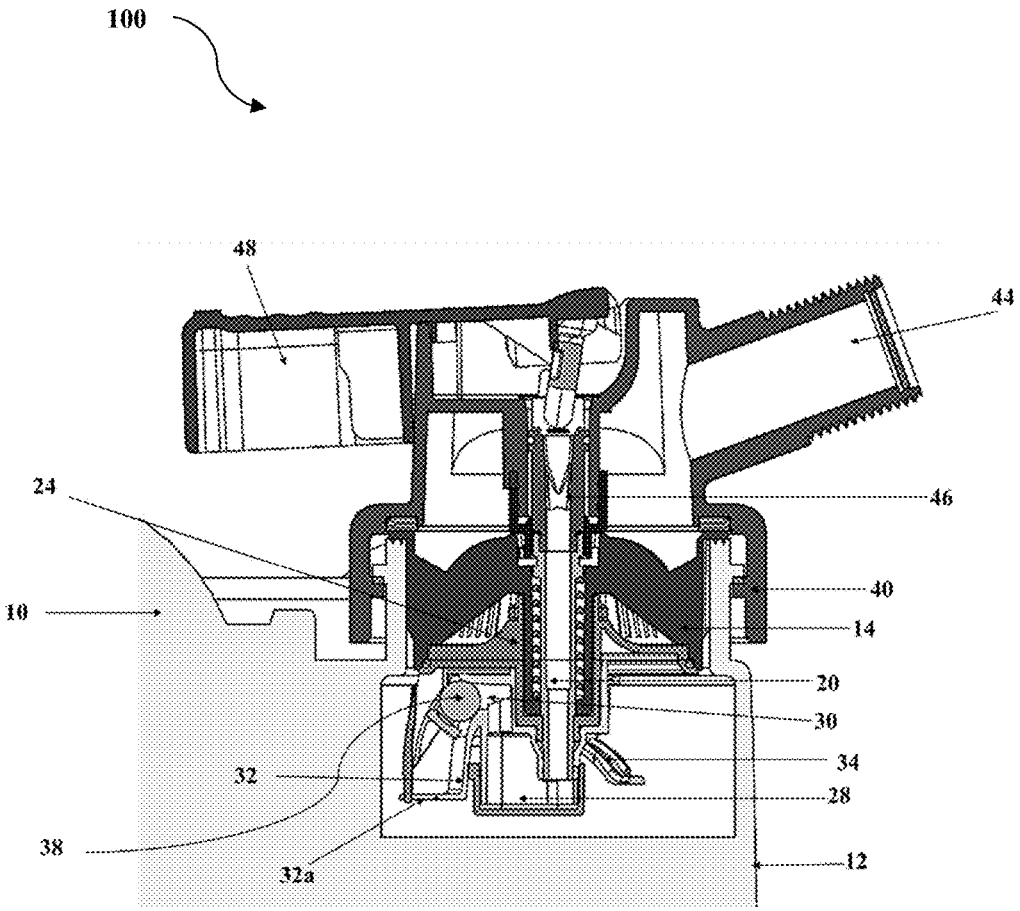
FIG. 5 illustrates a sectional view of the assembly of FIG. 4A in shut-off position in accordance with an embodiment of the present disclosure.
Figure 6:
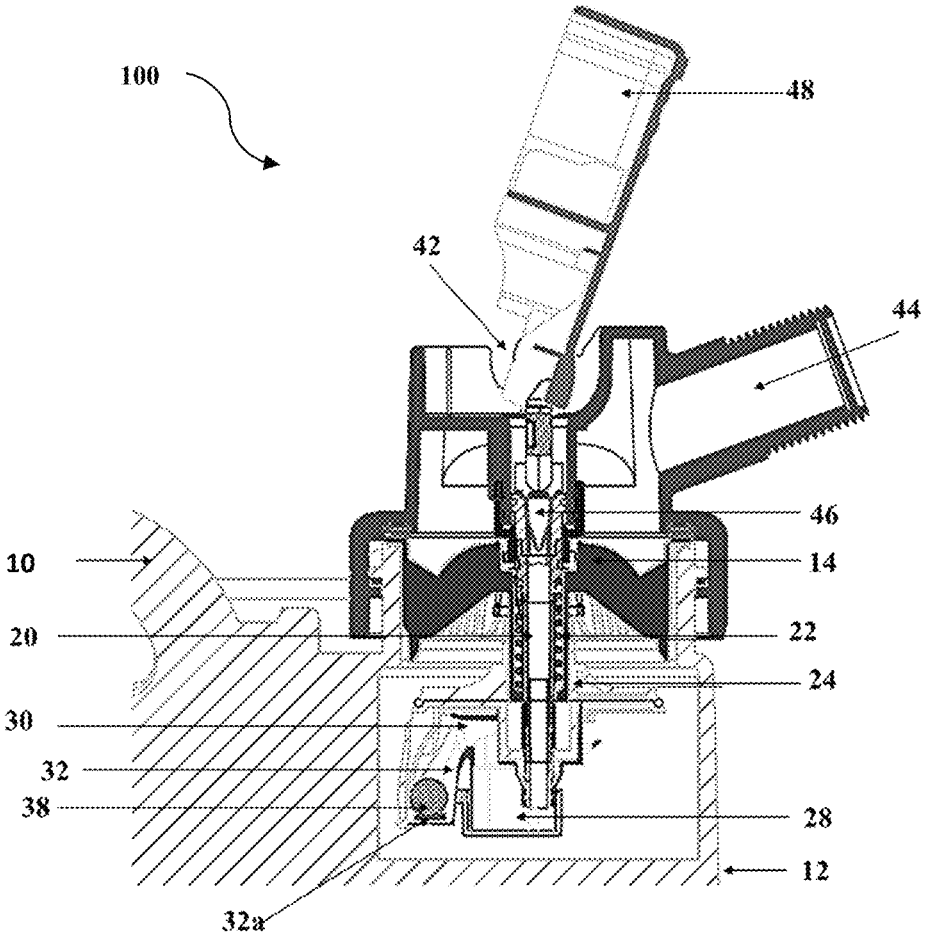
FIG. 6 illustrates a sectional view of the assembly of FIG. 4B in ON position in accordance with an embodiment of the present disclosure.

Further, the hollow shaft (20) is configured to be locked inside the first central passage (18) by means of a locking fixture (64). The locking fixture (64) is configured with a through-hole and a plurality of internal jaws provided thereon. The locking fixture (64) is press-fitted within the periphery of the first central passage (18). The hollow shaft (20) is allowed to receive in to the first central passage (18) passing through the through-hole and the biasing means (22) and allowed to get locked by the engagement of the plurality of the internal jaws with the groove configured on the hollow shaft (20). Thus, the movement of the hollow shaft (20) is restricted against the compressive force of the biasing means (22). FIG. 4A illustrates an isometric view of the assembly of adaptor and the neck housing on the container for refilling and decanting of fluid of FIG. 1 in shut-off position in accordance with an embodiment of the present disclosure; and FIG. 4B illustrates an isometric view of the assembly of adaptor and the neck housing on the container for refilling and decanting of fluid of FIG. 1 in ON position in accordance with an embodiment of the present disclosure. FIG. 5 illustrates a sectional view of the assembly of FIG. 4A in shut-off position and FIG. 6 illustrates a sectional view of the assembly of FIG. 4B in ON position in accordance with an embodiment of the present disclosure;

In an embodiment, the biasing means (22) is a coiled spring. The number of turns of the spring depends upon the compressive force required in the operation.

Further, the lower operative portion of the enclosure (14) is configured to be fitted with the diaphragm (24). The diaphragm (24) is defined by a disc-like structure with a second central passage (26) protruding from an operative surface of the diaphragm (24). A flap-plate (52) is configured to extend from a circumferential edge of the diaphragm (24) in a D-shaped pattern. A pair of lugs (60) are defined along circumference of the diaphragm (24). Each of the lug (60) is configured to receive each of the D-shaped contour (58) and is further configured to guide the diaphragm during actuation. The flap-plate (52) is configured with a guide-way (54) on an operative inner surface. The diaphragm (24) is configured to be concentrically fitted within the enclosure (14) such that the second central passage (26) defined on the diaphragm (24) is configured to be locked on to the protruded portion of the hollow shaft (20). Thus, the fitment of the diaphragm (24) with the enclosure (14) defines a cavity therebetween to collect the flowing fluid thereon.

Figure 7:
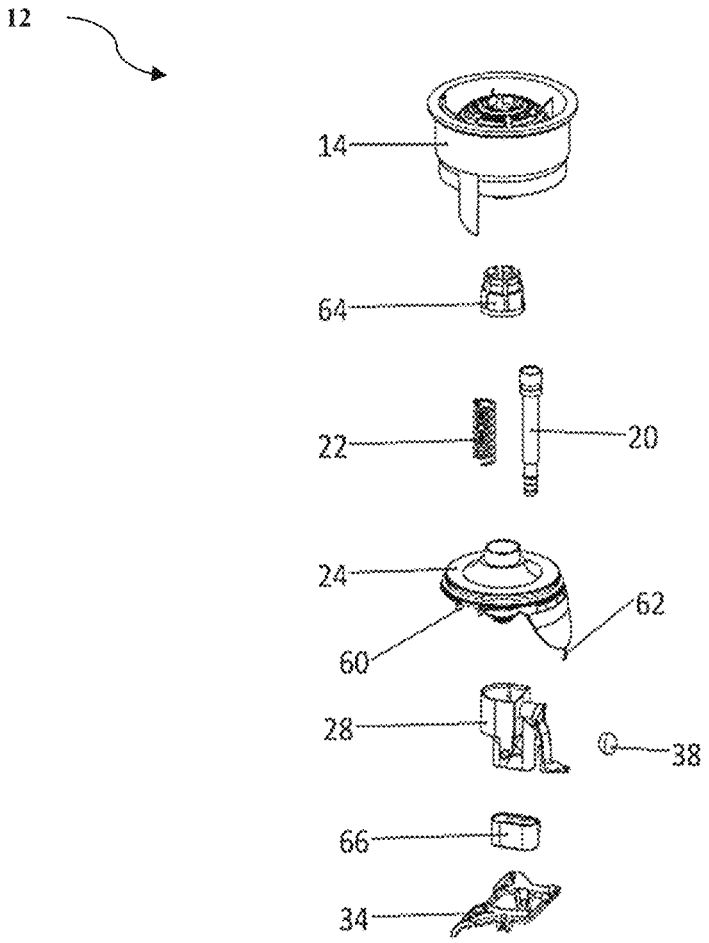
FIG. 7 illustrates a perspective exploded isometric view of the neck housing of FIG. 2 in accordance with an embodiment of the present disclosure.
Figure 8A:
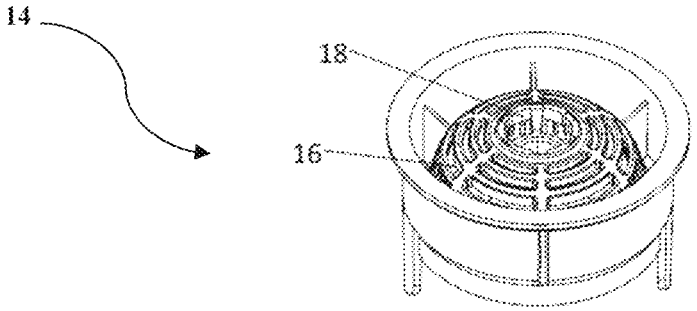
FIG. 8A illustrates a perspective isometric view of the enclosure in upright position in accordance with an embodiment of the present disclosure.
Figure 8B:
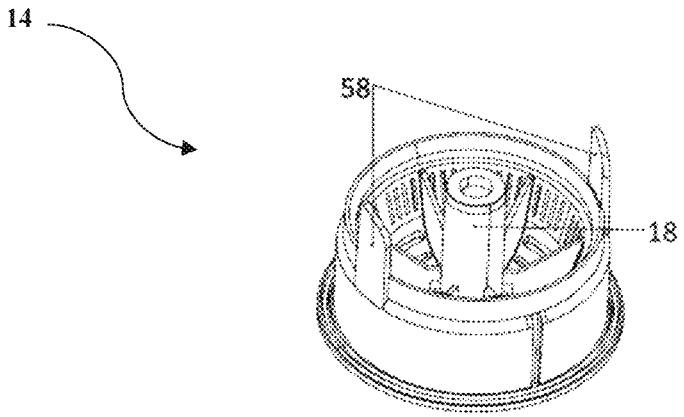
FIG. 8B illustrates a perspective isometric view of the enclosure in downward position in accordance with an embodiment of the present disclosure.

Therefore, the linear displacement of the hollow shaft (20) displaces the diaphragm (24) to thereby defines a fluid-orifice (50) thereon to provide a fluid flow path. The fluid-orifice (50) is configured circumferentially along the matting edges of the diaphragm (24) and the enclosure (14). FIG. 7 illustrates a perspective exploded isometric view of the neck housing of FIG. 2, FIG. 8A illustrates a perspective isometric view of the enclosure in upright position; and FIG. 8B illustrates a perspective isometric view of the enclosure in downward position in accordance with an embodiment of the present disclosure.

In an embodiment, the linear displacement of the hollow shaft (20) displaces the diaphragm and thus creates the fluid orifice in a range between 8 mm-12 mm.

In a preferred embodiment, the linear displacement of the hollow shaft (20) displaces the diaphragm and thus creates the fluid orifice of 10 mm.

In an embodiment, an operative lower portion of the flap plate (52) is configured with a pin (62) having a tapered needle portion.

In an embodiment, each of the lug (60) is configured to restrict the rotational degree of freedom of the diaphragm (24) during the linear displacement of the diaphragm (24) during actuation.

In an embodiment, the second central passage (26) is rotatably mounted to the protruded portion of the hollow shaft (20), Thus, the hollow shaft (20) acts as a valve actuator for the diaphragm (24).

In an embodiment, the circumferential edge of the diaphragm (24) is configured with a washer to perfectly lock the fluid-orifice (50) under the biasing force of the biasing means (22). The fluid-orifice (50) remains in closed position under the tensile force of the biasing means (22).

In an embodiment, the plurality of perforations (16) is configured to allow the fluid to flow in and out of the container (10) upon actuation the diaphragm (24) through the fluid-orifice (50).

In an embodiment, the protruded portion of the hollow shaft (20) is coinciding with the second central passage (26).

Figure 9:
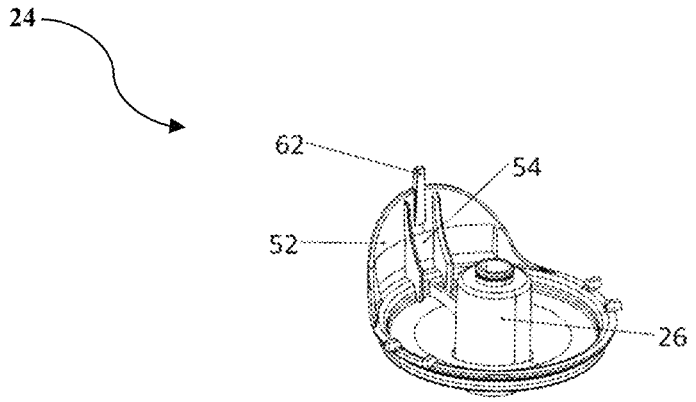
FIG. 9 illustrates a perspective isometric view of the diaphragm in operative position in accordance with an embodiment of the present disclosure.
Figure 10:
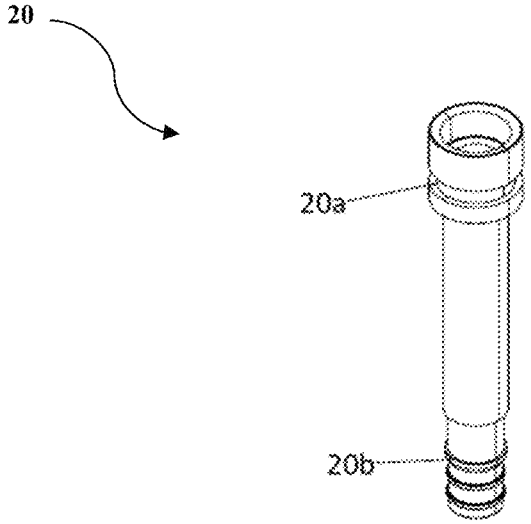
FIG. 10 illustrates a perspective isometric view of the hollow shaft in operative position in accordance with an embodiment of the present disclosure.
Figure 11:
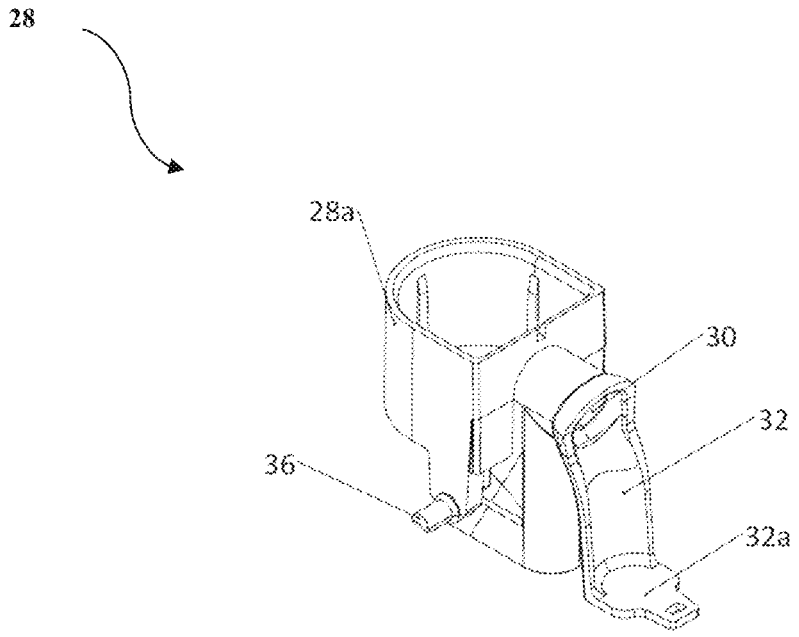
FIG. 11 illustrates a perspective isometric view of the NR-valve in operative position in accordance with an embodiment of the present disclosure.

Further, an outer surface of the second central passage (26) is configured to lockingly receive an operative cavity of the non-return valve (NR-valve) (28). The NR-valve (28) is configured with an air-orifice (30) and a guide-channel (32) slopping downward from the air-orifice (30). The air-orifice (30) is in fluid communication with the second central passage (26) of the diaphragm (24). An operative end of the guide-channel (32) is configured with a flat base-portion (32*a*). Further, the flat base portion (32*a*) is also configured with a hole. The pin (62) provided on the flap-plate (52) is configured to receive within the hole of the flat base portion (32*a*) so as to define a closed space therebetween to receive a closing means (38). The closing means (38) rest on a depression (38*a*) provided on the fulcrum (34). The fulcrum (34) is pivotally mounted on either side of the NR-valve (28) at a fulcrum point (36) to facilitate seesaw movement to the fulcrum (34) under the action of the deadweight. Thus, the closing means (38) is configured to slide within the guide-channel (32) between the flat base portion (32*a*) and the air-orifice (30) under the action of a fulcrum (34). Thereby, it enables the opening and closing of the air-orifice (30) to define an air flow path (72*a*, 72*b*). The inner operative surface of the flap-plate (52) acts as a protective surface for the closing means (38) and the guide-way (54) provided on flap-plate (52) keeps the closing means (38) within the guide-channel (32). FIG. 9 illustrates a perspective isometric view of the diaphragm in operative position, FIG. 10 illustrates a perspective isometric view of the hollow shaft in operative position and FIG. 11 illustrates a perspective isometric view of the NR-valve in operative position in accordance with an embodiment of the present disclosure.

Figure 12A:
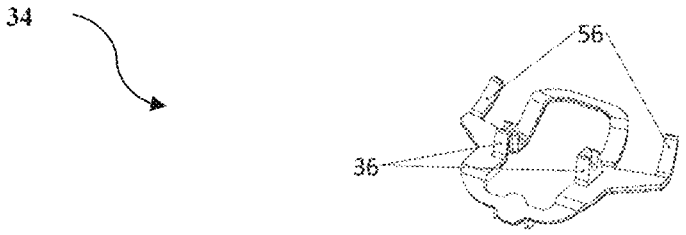
FIG. 12A-12B illustrates a perspective isometric view of the fulcrum in operative position in accordance with an embodiment of the present disclosure.
Figure 12B:
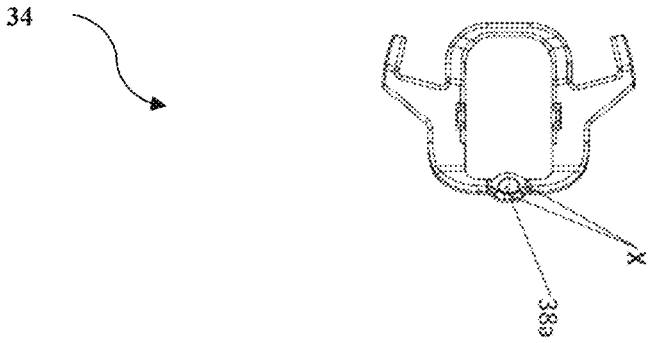

FIG. 12A-12B illustrates a perspective isometric view of the fulcrum in operative position in accordance with an embodiment of the present disclosure;

In an embodiment, the closing means (38) is a steel ball, configured to slide within a smooth frictionless surface of the guide-channel (32) to facilitate the closing and opening of the air-orifice (30).

In an embodiment, the NR-valve (28) is provided with an end cap (66) to lock an opening provided at operative lower surface of the NR-valve (28).

Further, the fulcrum (34) is configured with a pair of arms (56) define as a wing of a bird extending on either side from the fulcrum point (36) of the fulcrum (34). Each of the arm (56) is configured to abut on an operative inner surface of each of the D-shaped contour (58).

In an embodiment, the each of the arm (56) is configured to extend from a fulcrum point on either side of the non-return valve (28).

In an embodiment, the NR-valve (28) is located below to the operative surface of the diaphragm (24).

In an embodiment, the air-orifice (30) is located operatively below the fluid-orifice (50). The air-orifice (30) is positioned such that it does not allow the fluid to enter in the air-orifice (30) from the fluid-orifice (50) while filling and decanting.

Further, the adaptor (40) defined by a housing (40*a*) which includes a lever (48), first passage (42) and second passage (44) with a central piston (46). The adaptor (40) is provided with a peripheral engagement region (40*c*) to lock on the neck region (68) of the container (10) above the operative surface of the neck housing (12). The first passage (42) is configured to facilitate air to flow through the adaptor (40) during refilling and decanting. The second passage (44) is configured to facilitate fluid to flow through the adaptor (40) during filling and decanting. The central piston (46) is defined by a hollow-tubular body, and is configured to abut an operative portion of the hollow shaft (20) to fluidly connect the first passage (42) with the hollow shaft (20).

Figure 13:
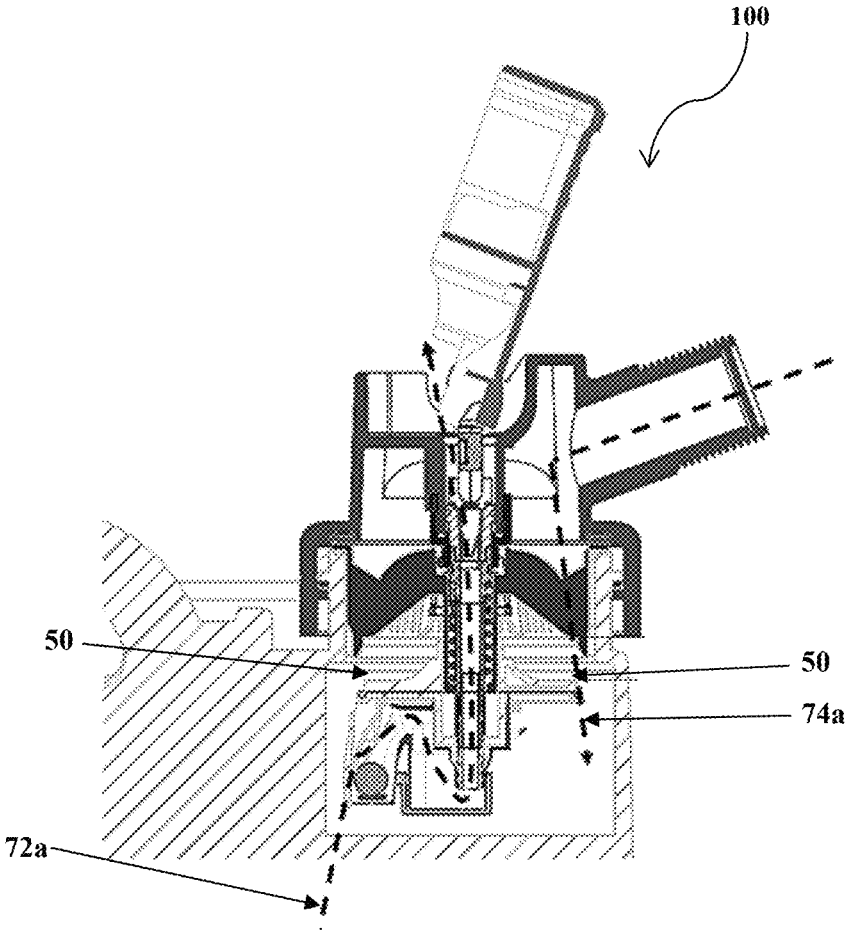
FIG. 13 illustrates a perspective sectional view of the assembly of FIG. 4B in ON position for refilling of fluid into the container, in accordance with an embodiment of the present disclosure.

In an embodiment, the inner surface of the peripheral engagement region (40*c*) includes a plurality of grooves configured thereon. The rotation of the adaptor (40) in clockwise direction causes protrusions (70) provided on the neck of the container (10) to engage with the grooves to allow the adaptor (40) to securely lock onto the neck region (68) of the container (10). The adaptor (40) is rotated till the adaptor lever (48) is inline with a handle of the container (10). The FIG. 5 illustrates a perspective sectional view of the assembly with the adaptor in shut-off position; The FIG. 6 illustrates a perspective sectional view of the assembly with the adaptor in ON position. FIG. 13 illustrates a perspective sectional view of the assembly of FIG. 4B in ON position for refilling of fluid into the container, in accordance with an embodiment of the present disclosure.

Upon actuation of the lever (48).i.e. the lever is pivotally attached to the adaptor (40) and is configured to move between idle position and an upright position.

Therefore, when the lever (48) moves from the idle position to the upright position, an actuator link (48*a*) of the adaptor pushes the central piston (46) and thereby the hollow shaft (20) is allowed to linearly displace within the first central passage (18) against the biasing force of the biasing means (22). Thereby, the displacement of the hollow shaft (20) displaces the diaphragm (24) from its mean position to facilitate the opening of the fluid-orifice (50) defined between the enclosure (14) and the diaphragm (24). In addition, the displacement of the diaphragm (24) also actuates the fulcrum (34) and make the fulcrum (34) to angularly rotate from its mean position of closed air-orifice (30) to the opening of the air-orifice (30) of the non-return valve (28).

In an embodiment, the first passage (42) is configured near the pivot portion of the lever (48).

In an embodiment, the second passage (44) is configured opposite to the lever (48).

Therefore, during filling and decanting of the container (10), the lever (48) of the adaptor (40) is configured to be raised to the upright position which linearly displace the hollow shaft (20) within the first central passage (18) to facilitate the displacement of the diaphragm (24) away from the enclosure (14). Thus, it opens the fluid-orifice (50) and enable the fluid flow in or out of the container (10) through the second passage (44) of the adaptor into the plurality of perforations (16) towards the fluid-orifice (50).

Simultaneously, the linear displacement of the diaphragm (24) is configured to pivotally rotate the fulcrum (34) from the closed position of the air-orifice (30) towards the open position to facilitate air to flow in or out of the container (10) to enable filling and decanting of fluid in the container (10). During filling of fluid, the entrapped air flows out of the container (10) by flowing through the air-orifice (30), the hollow shaft (20) and comes out of the adaptor (40) through the first passage (42), whereas during decanting of the fluid, the air moves through the first passage (42) of the adaptor (40) in to the container (10) passing via the hollow shaft (20) and the air-orifice (30).

In a preferred embodiment, the central piston (46) and the hollow shaft (20) are inline in closed position of the adaptor (40) and the neck housing (12).

Further, during idle or shut-off condition of the lever (48) of the adaptor, the air-orifice (30) remains in locked position by means of the dead weight (38) and the fluid-orifice (50) remains intact at closed position under the compression force of biasing means (22).

In an operative configuration, when the container (10) is to be refilled, the operator mount the adaptor (40) onto the neck region (68) of the container (10). Further, the operator raises the lever (48) of the adaptor (40), which causes the central piston (46) to push down and engage with the hollow shaft (20). The operation of the lever (48) causes simultaneous actuation of the diaphragm (24) and the fulcrum (34), to thereby it opens the air-orifice (30) and the fluid-orifice (50) simultaneously. This allows entrapped air to flow via the airflow path (72*a*) through the first passage (42) of the adaptor (40), thereby allowing air to vent out from the container (10). At the same time, the fluid to be refilled flows into the container (10) flows via the second passage (44) of the adaptor and flows through the fluid flow path (74*a*), and perforations (16) of the neck housing (12) into the container (10).

Similarly, while decanting, the lever (48) is raised by the operator to the upright position to allow the central shaft (46) to push down. This causes the central shaft to engage with the hollow shaft (20) or the valve actuator. The operation of lever (48) simultaneously operates the diaphragm (24), and the non-return valve (28).

This allows atmospheric air to flow via the first passage (42) of the adaptor (40), the path (72*b*) for the air to come inside the container (10). At the same time the fuel to be drawn outside the container (10) flows via the perforations (16) and the path (74*b*) of the neck housing (12) and flows through the second passage (44) to the user asset.

Figure 14:
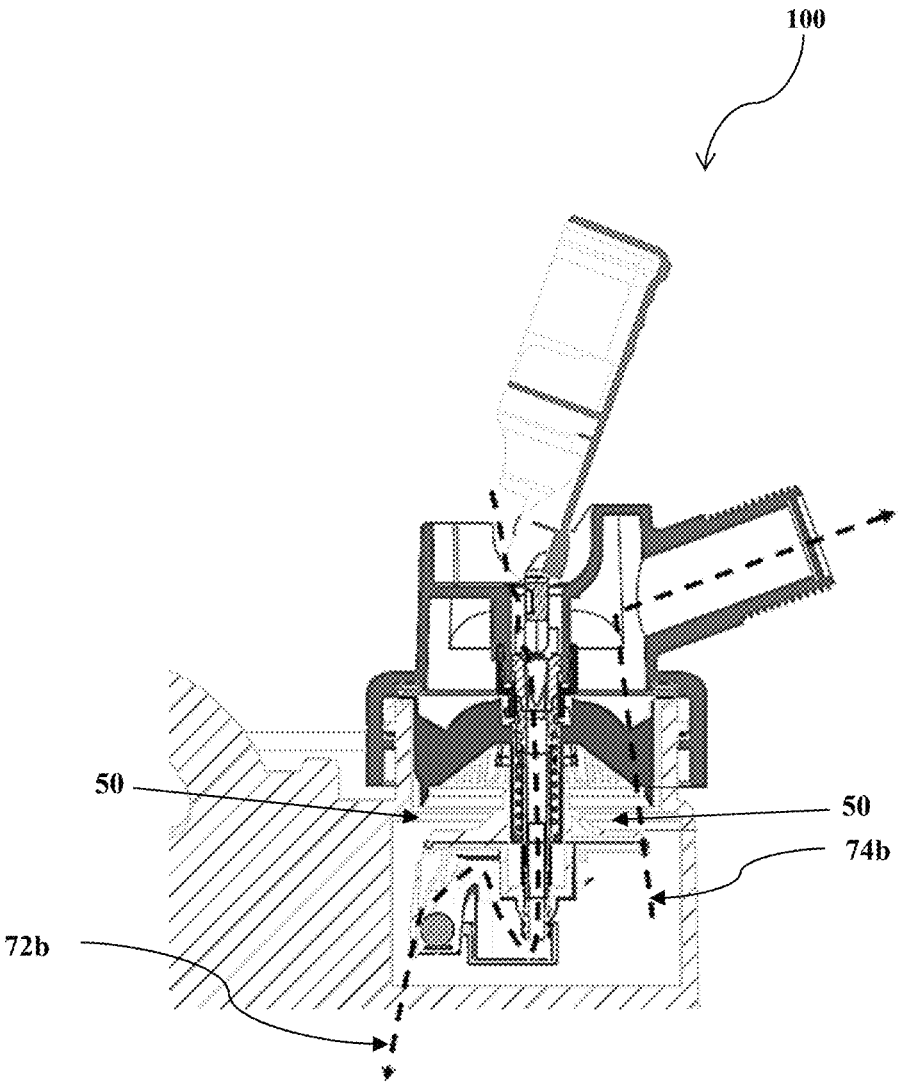
FIG. 14 illustrates a perspective sectional view of the assembly of FIG. 4B in ON position for decanting of liquid from the container, in accordance with an embodiment of the present disclosure.

Once the refilling or decanting operation is done, the lever (48) is pulled down, which simultaneously deactivates the diaphragm (24), and the non-return valve (28) to close the fluid-orifice (50) and the air-orifice (30) at the same time. Finally, the adaptor (40) is rotated in anti-clockwise direction to disengage the adaptor (40) from the neck region (68)

of the container (10). After removal of the adaptor (40), the neck housing (12) remains sealed with a cap be means of a tamper evident sealing means (72) to maintain the container (10) pilferproof. FIG. 14 illustrates a perspective sectional view of the assembly of FIG. 4B in ON position for decanting of liquid from the container.

In an embodiment, the neck housing (12) of the container (10) is operated by using the adaptor (40) for refilling and decanting purpose, thereby maintaining the container (10) pilferproof. Further, the container (10) prevents adulteration of liquid stored therein. More particularly, the operation of the lever (48) causes the flow of fluid and air to happen simultaneously from the single opening, which prevents pilferage of the stored product from the container (10). Further, the assembly (200) enables ease of refilling and decanting of container (10) in a pilferproof manner.

In an embodiment, the adaptor (40) and the neck housing (12) of the assembly (200) is manufactured from a material such as High Density Poly Ethylene (HDPE), or the like which can with stand stress and variations in temperature and is nonreactive to fuels, medicament, or chemicals etc.

In an embodiment, the fluid is selected from a group of liquid including fuel, precious liquid or like.

Referring to FIGS. 15, 16 and 17A-17B, for tamper evidence, the system includes a first identification media (102), a first application module (104), a server (108), a second application module (106), and a third application module (114). The first identification media (102) is attached/affixed to a seal (76) secured between the neck region (68) and a cap of each pilfer-proof fluid container (10*a-n*). As shown, the seal (76) is secured to the container (10*a-n*) such that it would be nearly impossible to remove it from the container (10*a-n*) undamaged. Each identification media (102) is configured to store a unique identifier, wherein the unique identifier helps in numbering the containers (10*a-n*) in a particular trip of fluid delivery.

In an embodiment, the identification media is a machine-readable visual code including, but not limited to, a one-dimensional code like a barcode, a 2D/data matrix code such as a QR code, and the like.

Further, the first application module (104) is configured to provide a first user interface to facilitate pre-registered customers to order pilfer-proof fluid containers (PFCs). The server (108) is configured to receive a list of orders for PFCs (10*a-n*) from the first application module (104) and is further configured to store the list of orders, information about the customers corresponding to each of the orders, and order details in a repository (108*a*).

In an embodiment, the order details for each customer includes the quantity of liquid and the type of liquid ordered by the customer. The customer information includes, but is not limited to, the customer's name, address/location, phone number, and other contact details, if any.

Further, the server (108) performs a customer authentication process before allowing the customers to use the first application module (104) to place the orders. In an embodiment, the server (108) facilitates the customer to generate or set a login ID and password and use the login ID and password as a credential to securely login to the first application module (104). In another embodiment, the server (108) performs authentication (i.e., facilitate secure login) by verifying/checking a pre-set secure code entered by the customer.

In an embodiment, the server (108) performs authentication by verifying/checking a biometric trait/feature of the customer, which includes one or more of fingerprints, face, iris, signature, finger vein, palm vein, voice sample, or any other form of biometric data of the customer.

Further, the second application module (106) is associated with the channel partner (hereinafter referred to as the "user") and the third application module (114) is associated with a delivery partner/agent. The second application module (106) is configured to facilitate the user or the delivery agent located at a retail outlet to view the order details via a second user interface and prepare/fill the PFCs (10*a-n*) based on the orders. The second application module (106) is further configured to facilitate the user/agent to scan the identification media (102) on each PFC (10*a-n*), extract the unique identifier stored therein, and send the extracted unique identifier to the server (108). The server (108) stores the unique identifier against the order details for which the PFC (10*a-n*) is filled in the repository (108*a*). Thus, the unique identifier of the PFCs (10-*n*) is associated with the order details such as customer name, customer location/address, the quantity of liquid ordered, quantity of liquid filled, etc.

The prepared/filled PFCs are transported by the driver partner from the retail outlet premises to the customer locations for delivery. At the customer premises, the first application module (104) and/or the third application module (114) is configured to allow the delivery agents or customers to scan the identification media (102) secured to the seal (76) of the PFC (10*a-n*) and extract order details corresponding to the unique identifier associated with the PFC (10*a-n*) from the server (108). If the identification media (102) is tampered with, replaced, or damaged, the first/second application module (104, 106, 114) will not be able to read the unique identifier and retrieve the information corresponding to the identifier from the server 108, and therefore prevent the user from receiving the tampered container.

The system thus identifies whether a PFC (10*a-n*) is tampered with and thus detects any pilferage or theft during the storage and transportation of liquids stored in PFC (10*a-n*). Further, the system ensures that the quantity and type of PFCs 10*a-n* are correct and it is prepared and delivered as per the customer's requirement.

Thus, if some theft happens during the storage or transport of the fluid, the seal (76) and the identification media (102) will get damaged and the customer will be able to identify the damage. Further, if someone attempts to steal the liquid within the container by breaking the identification media (102) and the seal (76) and replacing them with a new identification media and seal, the system will display an error, when the identification media (102) is scanned at the point of delivery.

Figure 15:
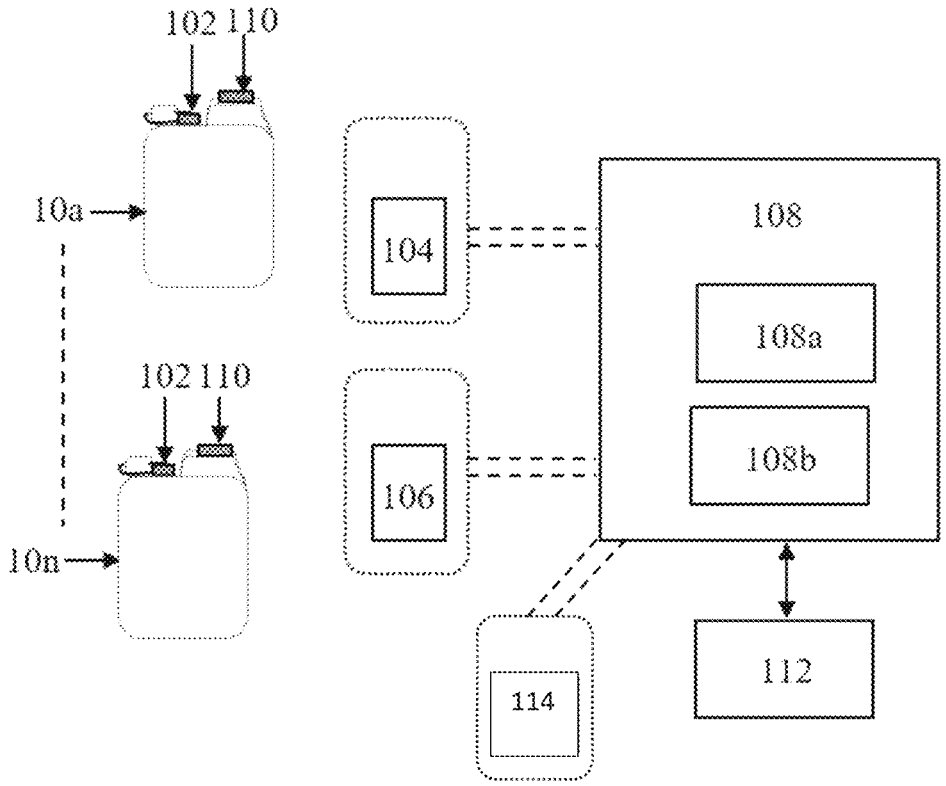
FIG. 15 illustrates a block diagram of a system for identification and monitoring of pilfer-proof fluid containers, in accordance with an embodiment of the present disclosure.
Figure 16:
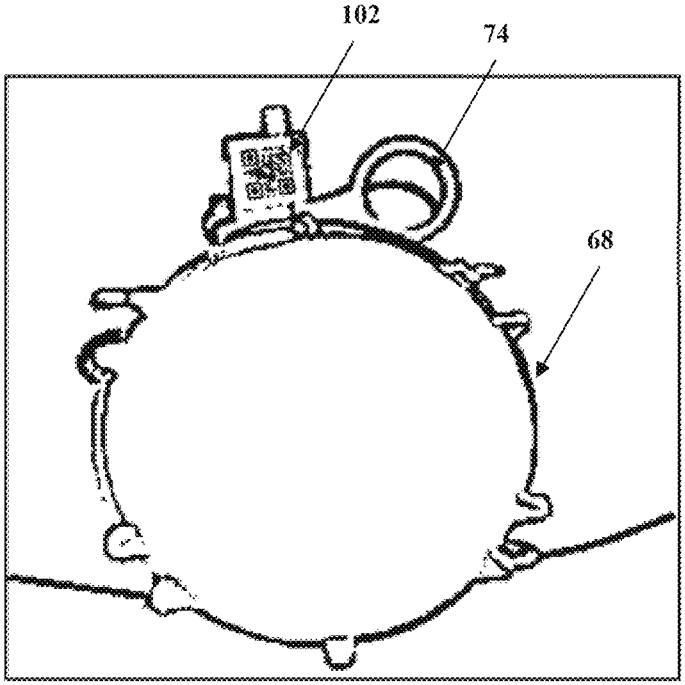
FIG. 16 illustrates a schematic view of a seal of the system of FIG. 15, in accordance with an embodiment of the present disclosure.
Figure 17A:
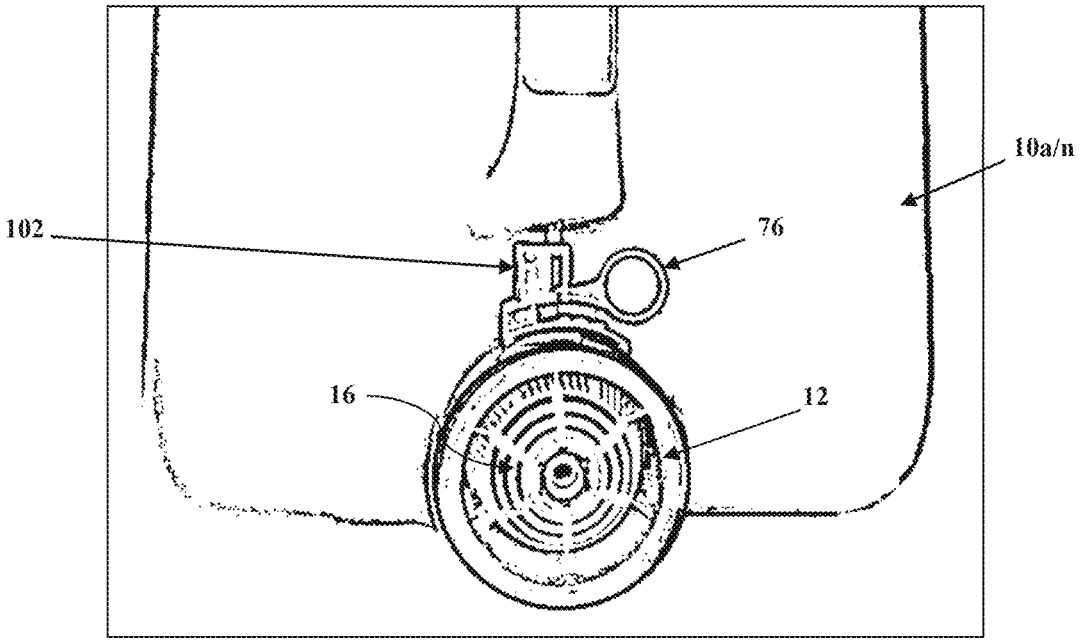
FIGS. 17A and 17B illustrate schematic views of the seal of FIG. 16 with an identification media, mounted on a pilfer-proof fluid container, in accordance with an embodiment of the present disclosure.
Figure 17B:
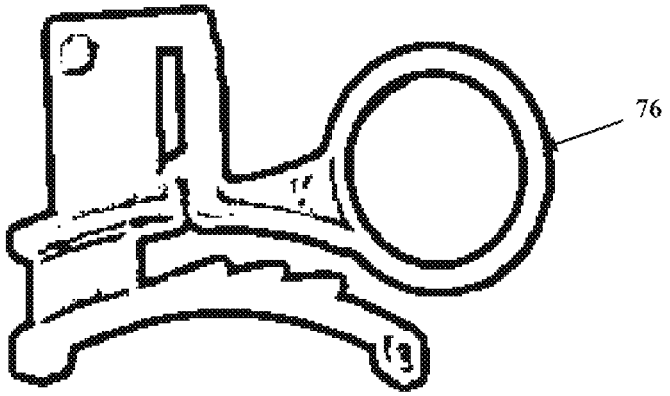

In an embodiment, the system additionally includes a radio frequency identification (RFID) tag (110). The RFID tag (110) is housed within a pocket provided in the PFC's handle as shown in FIG. 15. Alternatively, the RFID tag (110) is disposed in the PFC's handle. Each RFID tag (110) stores a unique alphanumeric code. At the time of filling the PFCs (10*a-n*) from a dispenser, a nozzle reader attached to a hose of the dispenser may be configured to read the RFID tags (110), extract the unique alphanumeric code therefrom, and send the unique alphanumeric code associated with the PFCs (10*a-n*) to the server (108) through a gateway. The server (108) is configured to register the alphanumeric codes of the PFCs (10*a-n*) against the particular delivery trip. The server (108) sends a command to a forecourt device to start filling the PFCs (10*a-n*) based on the order details of the day. The system further comprise a controller unit (112) disposed on a carrier. After the PFCs (10*a-n*) are filled and loaded onto the carrier for delivery, the controller unit (112) disposed on the carrier may be configured to read the RFID tags (110) of all the PFCs (10*a-n*) during transportation at regular intervals of time. The controller unit (112) is further configured to send the read information to the server (108). A computation module (108*b*) in the server (108) check whether the received information contains alphanumeric codes corresponding to all the PFCs (10*a-n*) loaded on the carrier and associated with the trip. This is done to ensure that the carrier has all registered PFCs 10*a-n* with it during the whole transportation period. Any missing PFC (10*a-n*) will be identified by the server (108) and communicated to the user/agent via the second or third application module (106, 114).

Whenever a PFC (10*a-n*) is unloaded from the carrier at any asset geo-fenced location, the nozzle reader fixed on the hose may send the PFC's alphanumeric code to the server (108) via the controller unit (112). The server (108) then identify the PFC (10*a-n*) based on the alphanumeric code and cause the controller unit (112) to send a command to activate a solenoid valve within the PFC (10*a-n*). This will allow fuel to flow out of the PFC (10*a-n*) and into a customer asset inlet via the hose. Accordingly, the server (108) is configured to maintain a status of each PFC 10*a-n* as 'filled' or 'empty'.

Thereafter, the controller unit (112) is configured to keep the decanted PFC (10*a-n*) under constant monitoring till it reaches its original location. During the entire transportation process, if any PFC 10*a-n* is found to be missing or the RFID tag (110) of a PFC (10*a-n*) cannot be read, the server (108) will raise an alarm and send an alert message to the user and/or the concerned authority. The server (108) also sends the alert message to the first and/or second and/or third application modules (104,106,114) to notify the user and/or the customer and/or the delivery agent about the missing PFC(s) (10*a-n*).

The RFID tag (110) thus helps in monitoring the movement of the containers within a field, resulting in the efficient management of inventory.

Additionally, to ensure the secure delivery of the PFCs (10*a-n*), the server (108) is configured to send a one-time password to the customers associated with the ordered PFCs (10*a-n*). At the time of delivery, the customer will share the OTP with the delivery agent. The delivery agent will enter the OTP into the third application module (114) via a third user interface. The third application module (114) will send the OTP back to the server (108). The server (108) verifies if the OTP generated for the customer is the same as the OTP received from the delivery agent. If the OTP is verified, such a message will be shown to the delivery agent on the third application module (114). The delivery agent then performs decantation of the ordered quantity of fuel using an adaptor into the customer's assets. The sealing means (76) is configured to be received between the operative surface of neck region (68) and an inner surface of a cap mounted thereon to restrict unauthorized opening of the cap from the container (10).

Advantageously, the first application module (104), the second application module (106), the third application module (114), the computation module (108*b*), and the controller unit (112) disclosed herein is implemented or executed using one or more processor(s).

In an embodiment, the processor is a general-purpose processor, a Field Programmable Gate Array (FPGA), an Application Specific Integrated Circuit (ASIC), a Digital Signal Processor (DSP), and/or the like. The processor is configured to retrieve data from and/or write data to the memory.

In an embodiment the memory is, for example, a random-access memory (RAM), a memory buffer, a hard drive, a database, an erasable programmable read only memory (EPROM), an electrically erasable programmable read only memory (EEPROM), a read only memory (ROM), a flash memory, a hard disk, a floppy disk, cloud storage, and/or so forth.

The order to delivery process as envisaged by the system and the method of the present disclosure is as follows—

1. Ordering—
   - A pre-registered customer places an order for one or more PFCs 10*a-n* online via the first application module (104).
   - The customer makes payment via a payment option such as e-Payment/pay from wallet/pay at retail outlet.
   - The system allows the customer to place orders up to 3 days in advance and express order for same-day delivery.
2. Delivery Planning—
   - Based on the orders received, the petrol pump staff plans a trip for every delivery vehicle and assigns orders to the trip/vehicle.
   - The orders are automatically routed to retail outlet(s) fuel control systems for filling.
   - A driver, assigned by the petrol pump staff, takes the delivery vehicle to the retail outlet(s).
3. Filling—
   - The retail outlet staff selects individual orders in the fuel control systems for filling.
   - High-Density Polyethylene containers (HDPE PFCs) are filled using an adaptor and a brass plug/coupler at the retail outlet.
   - After filling, a tamper-evident sealing means (76) is fixed on the HDPE PFC.
   - An identification media (102) such as a QR code is applied on tamper-evident sealing means (76) and it is scanned using a mobile phone at the retail outlet.
4. Transportation—
   - After filling PFCs 10*a-n* under the surveillance of the retail outlet, HDPE PFCs 10*a-n* are loaded into a vehicle (truck) for delivery of PFCs 10*a-n* to customer asset locations.
   - The driver may use an in-app navigation feature to reach all customer assets in a trip.
5. Authentication—
   - Every customer order may have a Customer Relationship Number (CRN)/One-time Password (OTP) which the customer may share with the delivery agent.
   - The delivery agent keys in the CRN/OTP via the third application module (114).
   - The QR code (102) applied on every HDPE PFC 10*a-n* may be scanned again by the delivery agent using a mobile phone before decantation in front of the customer.
6. Decantation—
   - The cap of the PFC 10*a-n* is opened in front of the customer by snapping tamper-proof seal 20 which also tears the QR code 102.
   - After that, decantation of the ordered quantity of fuel is done using the adaptor in the customer's assets.

7. Settlement/Refund—
   - Post-delivery, the system automatically initiate settlements and refunds (if any).
   - Customers can view/download invoice via the first application module (104).
   - Any applicable refund remitted automatically to the customer account.

Figure 18A:
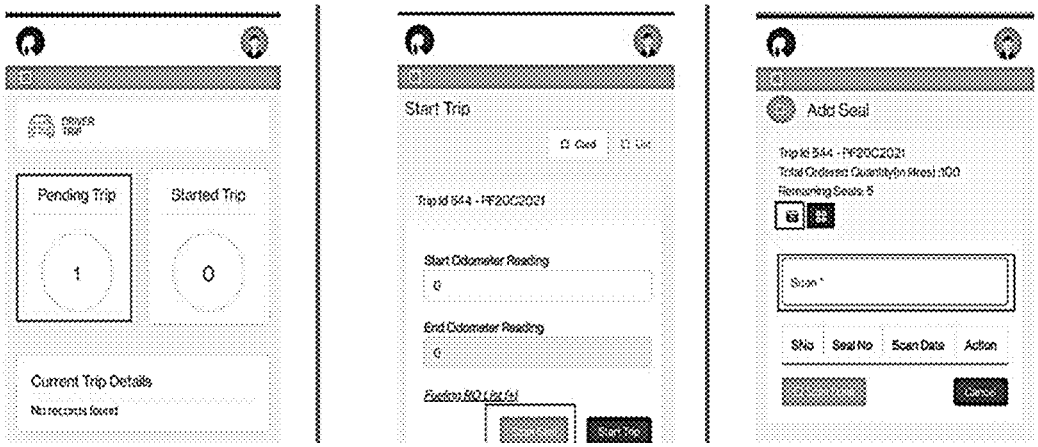
FIG. 18A illustrates an exemplary user flow for filling and scanning the pilfer-proof fluid containers at the retail outlet premises, in accordance with an embodiment of the present disclosure.
Figure 18B:
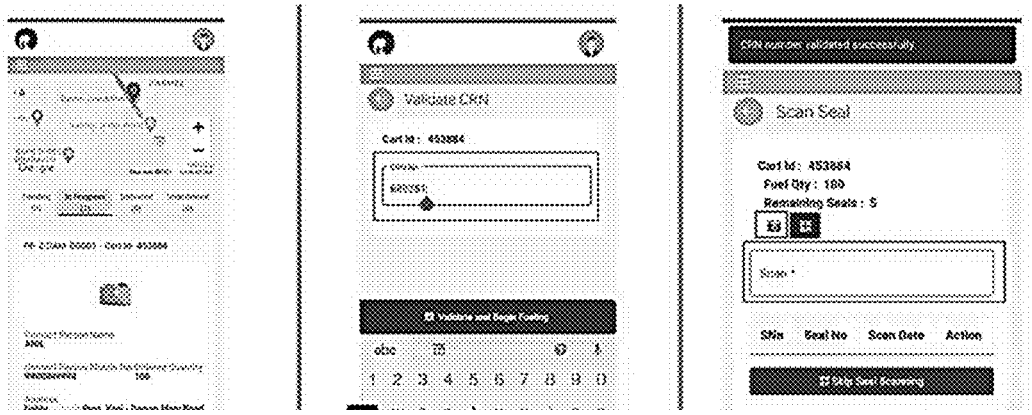
FIG. 18B illustrates an exemplary user flow for completing the decantation process at the customer's premises, in accordance with an embodiment of the present disclosure.

In an operative embodiment, referring to FIGS. 18A-18B, the method for identification and monitoring of PFCs comprises the following steps—

- Scanning, by a delivery operation staff, an identification media (102) pasted on a fluid container 10*a-n* to be delivered, using a second/third application module (106, 114). This involves:
  - Opening, the second application module (106), on a user device and logging in.
  - Clicking on the pending trip on Screen 1 (of FIG. 18A) and selecting the trip.
  - Clicking on 'scan seal' option on Screen 2 as shown in FIG. 18A.
  - Selecting the camera button on Screen 3 to open the camera.
  - Positioning the camera such that the identification media (102) is completely visible. The identification media (102) will be scanned and data will be uploaded to the second application module (106).
  - Scanning the identification media (102) on all the containers (10*a-n*) which are to be delivered on that particular trip.
  - Clicking on a 'scan done' button to lock all the scanned seals to the driver's trip, the second/third application module (106, 114) will prompt the driver to start the trip.
- On the subsequent page, feeding in the odometer reading and starting the trip.
- Thereafter, clicking on the 'start for fuelling' icon on the subsequent page.
- This will shift the order to in progress state.

Referring to FIG. 18B, upon reaching the customer's premises, the delivery agent click on 'begin fueling'. The delivery agent enter the CRN no. shared by the customer and then click on the button 'validate and begin fueling'. On the next page, the delivery agent click on the scan button and scan the identification media (102) applied to the containers (10*a-n*) in the customer's presence. Once the scanning is done, the agent click on 'scan done' and then mark the container 10*a-n* as delivered. Now the container's sealing means (76) is broken and the fuel is decanted from the container 10*a-n* into the customer asset as per the standard process.

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope and spirit of the disclosure and appended claims. For example, due to the nature of software, functions described above can be implemented using software executed by a processor, hardware, firmware, hardwiring, or combinations of any of these. Features implementing functions may also be physically located at various positions, including being distributed such that portions of functions are implemented at different physical locations.

The foregoing description of the embodiments has been provided for purposes of illustration and not intended to limit the scope of the present disclosure.

Individual components of a particular embodiment are generally not limited to that particular embodiment, but, are interchangeable. Such variations are not to be regarded as a departure from the present disclosure, and all such modifications are considered to be within the scope of the present disclosure.

TECHNICAL ADVANCES AND ECONOMICAL SIGNIFICANCE

The present disclosure described herein above has several technical advantages including, but not limited to, the realization of the pilferproof cap assembly for a container, that:

- facilitates refilling and decanting of fluid therefrom in a pilferproof manner;
- prevents pilfering of liquid therefrom;
- prevents adulteration of liquid stored therein; and
- ensures secure delivery of PFCs from retail outlets to destination;
- ensures delivery of PFCs to the customers based on their orders;
- monitors the quantity of PFCs in a trip;
- detects pilferage or theft of fluid from the PFCs during their storage and transportation;
- ensures secure delivery of PFCs from retail outlets to destination;
- ensures delivery of PFCs to the customers based on their orders;
- monitors the quantity of PFCs in a trip; and
- detects pilferage or theft of fluid from the PFCs during their storage and transportation.

The foregoing description of the specific embodiments so fully reveals the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

Throughout this specification the word "comprise", or variations such as "comprises" or "comprising", will be understood to imply the inclusion of a stated element, or step, or group of elements, or steps, but not the exclusion of any other element, or step, or group of elements, or steps.

The use of the expression "at least" or "at least one" suggests the use of one or more elements or ingredients or quantities, as the use may be in the embodiment of the disclosure to achieve one or more of the desired objects or results.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation.

The invention claimed is:

1. A pilferproof cap assembly (100) for a container (10), said assembly (100) configured to facilitate refilling and decanting of fluid in said container (10), said assembly (100) comprising:

a neck housing (12) configured to be fitted on an opening of said container (10), said neck housing (12) comprising:

an enclosure (14) configured with a plurality of perforations (16) and a first central passage (18) to facilitate fluid flow and air flow separately;

a hollow shaft (20) configured to be lockingly received within said first central passage (18) against compressive force of a biasing means (22) and further configured to protrude out through said first central passage (18);

a linearly displaceable diaphragm (24) configured to be concentrically fitted within said enclosure (14) and further configured to lock with an operative section of said hollow shaft (20) to define a second central passage (26), said linearly displaceable diaphragm (24) configured to define a fluid-orifice (50) for fluid flow through said plurality of perforations (16);

a non-return valve (28) configured with an air-orifice (30) and a guide-channel (32) slopping downward from said air-orifice (30), said air-orifice (30) is configured to be in fluid communication with said second central passage (26) to facilitate air flow in operative condition; and a fulcrum (34) is configured to be pivotally mounted to said non-return valve (28), and further configured to lift a closing means (38) along said guide-channel (32) to enable opening and closing of said air-orifice (30) to define an air flow path (72*a*, 72*b*), and an adaptor (40), configured to be mounted on an operative top of said neck housing (12), in an operative condition of said assembly, said adaptor is configured to actuate said linearly displaceable diaphragm (24) of said neck housing (12) to operate said fluid-orifice (50) and said air-orifice (30) simultaneously.

2. The assembly (100) as claimed in claim 1, wherein said fluid-orifice (50) of said neck housing (12) and said plurality of perforations (16) are in fluid communication in an operative configuration of said assembly (100) to define fluid flow path (74*a*, 74*b*).

3. The assembly (100) as claimed in claim 1, wherein said diaphragm (24) is configured to be received at a lower operative surface of said enclosure.

4. The assembly (100) as claimed in claim 3, said adaptor (40) further includes a lever (48), and is configured to move from idle position to an upright position to linearly displace said hollow shaft (20) by means of said central piston (46) against the biasing force of said biasing means (22) to displace said linearly displaceable diaphragm (24) to facilitate the opening of said fluid-orifice (50) defined between inner operative surface of said enclosure (14) and said diaphragm (24) and opening of said air-orifice (30) of said non-return valve (28).

5. The assembly (100) as claimed in claim 4, wherein during filling and decanting of said container (10), said lever (48) is configured to be raised to a position to linearly displace said hollow shaft (20) to facilitate the displacement of said linearly displaceable diaphragm (24) to define said fluid-orifice (50) and enable the fluid flow from said second passage (44) towards said fluid-orifice (50).

6. The assembly (100) as claimed in claim 5, wherein said linear displacement of said linearly displaceable diaphragm (24) is configured to pivotally rotate said fulcrum (34) from the closed position of said air-orifice (30) towards the open position to facilitate air to flow through said container (10) to enable filling and decanting of fluid in said container (10).

7. The assembly (100) as claimed in claim 5, wherein said lever (48) is configured to be lowered from the upright position to close said fluid-orifice (50) and said air-orifice (30).

8. The assembly (100) as claimed in claim 1, wherein said adaptor (40) includes:

a first passage (42) is configured to facilitate air to flow through said adaptor (40) during refilling and decanting;

a second passage (44) is configured to facilitate fluid flow through said adaptor (40) during filling and decanting; and a central piston (46) defined by a hollow-tubular body, said central piston (46) is configured to abut an operative portion of said hollow shaft (20) to fluidly connect said first passage (42) with the operative portion of said hollow shaft (20) in an operative condition of said assembly.

9. The assembly (100) as claimed in claim 1, wherein a flap-plate (52) is configured to extend from a circumferential edge of said diaphragm (24), said flap-plate (52) is configured with a guide-way (54) to guide said closing means (38) within said guide-channel (32).

10. The assembly (100) as claimed in claim 1, wherein said fulcrum (34) is configured with a pair of arms (56), each of said arm (56) is configured to extend from a fulcrum point on either side of said non-return valve (28).

11. The assembly (100) as claimed in claim 10, wherein a pair of flange portion (58) is configured with a D-shaped contours along said enclosure (14), each of said arm (56) is configured to abut on an operative surface of each of said D-shaped contour (58).

12. The assembly (100) as claimed in claim 11, wherein a pair of lugs (60) are defined at circumference of said linearly displaceable diaphragm (24), each of said lug (60) is configured to receive each of said D-shaped contour (58) to restrict the rotational degree of freedom during linear displacement of said linearly displaceable diaphragm (24).

13. The assembly (100) as claimed in claim 1, wherein said neck housing (12) is rigidly fitted on the opening of said container (10) by means of plastic soldering, ultrasonic welding, gluing or adhesive means.

14. The assembly (100) as claimed in claim 13, wherein the linear displacement of said linearly displaceable diaphragm (24) defines said fluid orifice in a range between 8 mm-12 mm.

15. The assembly (100) as claimed in claim 1, wherein an operative surface of a neck region of said container is configured with a tamper evident sealing means (76) with a bar code.

16. The assembly (100) as claimed in claim 1, wherein said tamper evident sealing means (76) is configured to be received between the operative surface of neck region (68) and an inner surface of a cap mounted thereon to restrict unauthorized opening of said cap from said container (10).

* * * * *